US007000847B2

(12) United States Patent
Alvarado

(10) Patent No.: US 7,000,847 B2
(45) Date of Patent: Feb. 21, 2006

(54) QUICK RECOVERY WATER HEATER

(75) Inventor: Andrés Guevara Alvarado, Saltillo Coahuila (MX)

(73) Assignee: Calentadores Cinsa, S.A. de C.V., Saltilo (MX)

( * ) Notice: Subject to any disclaimer, the term of this patent is extended or adjusted under 35 U.S.C. 154(b) by 75 days.

(21) Appl. No.: 10/835,841

(22) Filed: Apr. 29, 2004

(65) Prior Publication Data

US 2004/0222308 A1 Nov. 11, 2004

(51) Int. Cl.
*F24H 9/20* (2006.01)

(52) U.S. Cl. ..... 236/15 BE; 236/20 R; 122/14.1; 122/448.1; 237/56

(58) Field of Classification Search ..... 236/15 BE, 236/20 R; 122/14.1, 14.2, 14.22, 448.1; 237/56

See application file for complete search history.

(56) References Cited

U.S. PATENT DOCUMENTS 4,598,694 A * 7/1986 Cromer ..... 122/19.1
5,946,927 A * 9/1999 Dieckmann et al. ..... 62/238.6

* cited by examiner

*Primary Examiner*—Marc Norman
(74) *Attorney, Agent, or Firm*—Baker Botts L.L.P.

(57) ABSTRACT

A small water heater with a 29 cm outer diameter and a total height of 60 cm produces five liters of hot water per minute, with a difference of 25° C. between the water inlet and outlet, and an 85% thermal efficiency; this water heater has a heat recuperator 1 as shown in the description, a thermostat 2, a pipe capsule 10 to house the full sensory bar 3, a combustion chamber 4, a deflector chamber 5, a combustion gas collector 8, a water tank 9, a service door 7, a sheet sliding curtain 6, a plastic vein-type pipe 13, a magnesium anode 14, an exterior cover 17, an exterior lid 18, a flue 16, and a burner 15 that runs on combustible gas, with a power of 37,000 kj/hr.

13 Claims, 3 Drawing Sheets

QUICK RECOVERY WATER HEATER

CROSS REFERENCE TO RELATED APPLICATIONS

This application claims the benefit of Mexican Patent Application No. PA/a/2003/003822 filed on Apr. 30, 2003, which is incorporated herein by reference.

TECHNICAL FIELD OF THE INVENTION

This invention consists of a small domestic water heater, of the type known as quick recovery or pass-through water heater.

BACKGROUND OF THE INVENTION

At the present time, quick recovery water heaters have a very high contaminant release rate and high selling costs due to their inefficient burners and heat recovery methods.

SUMMARY OF THE INVENTION

In order to prevent said inconveniences and offer a better product to the consumers, the domestic water heater whose protection is sought with this application was devised, which mainly complements two protected inventions, namely, a heat recuperator for a horizontal boiler, Utility Model File No. 850, an IMPI-approved utility model that is incorporated herein by reference, and a burner with a turbulator that runs on combustible gas, covered by patent application file No. PA/a/2002/012631, pending at the IMPI, that is incorporated herein by reference. With these two devices and other innovations, a small, low-contaminant release rate, high thermal efficiency, and low-relative cost small water heater is achieved. These and other details are provided in the detailed description of the invention.

BRIEF DESCRIPTION OF THE DRAWINGS

For a more complete understanding of the present invention and the advantages thereof, reference is now made to the following description taken in conjunction with the accompanying drawings, wherein like reference numerals represent like parts, in which.

DETAILED DESCRIPTION OF THE INVENTION

This description is provided by way of illustration and not by way of limitation and mentions the reference numbers and the drawings attached.

Figure 1:
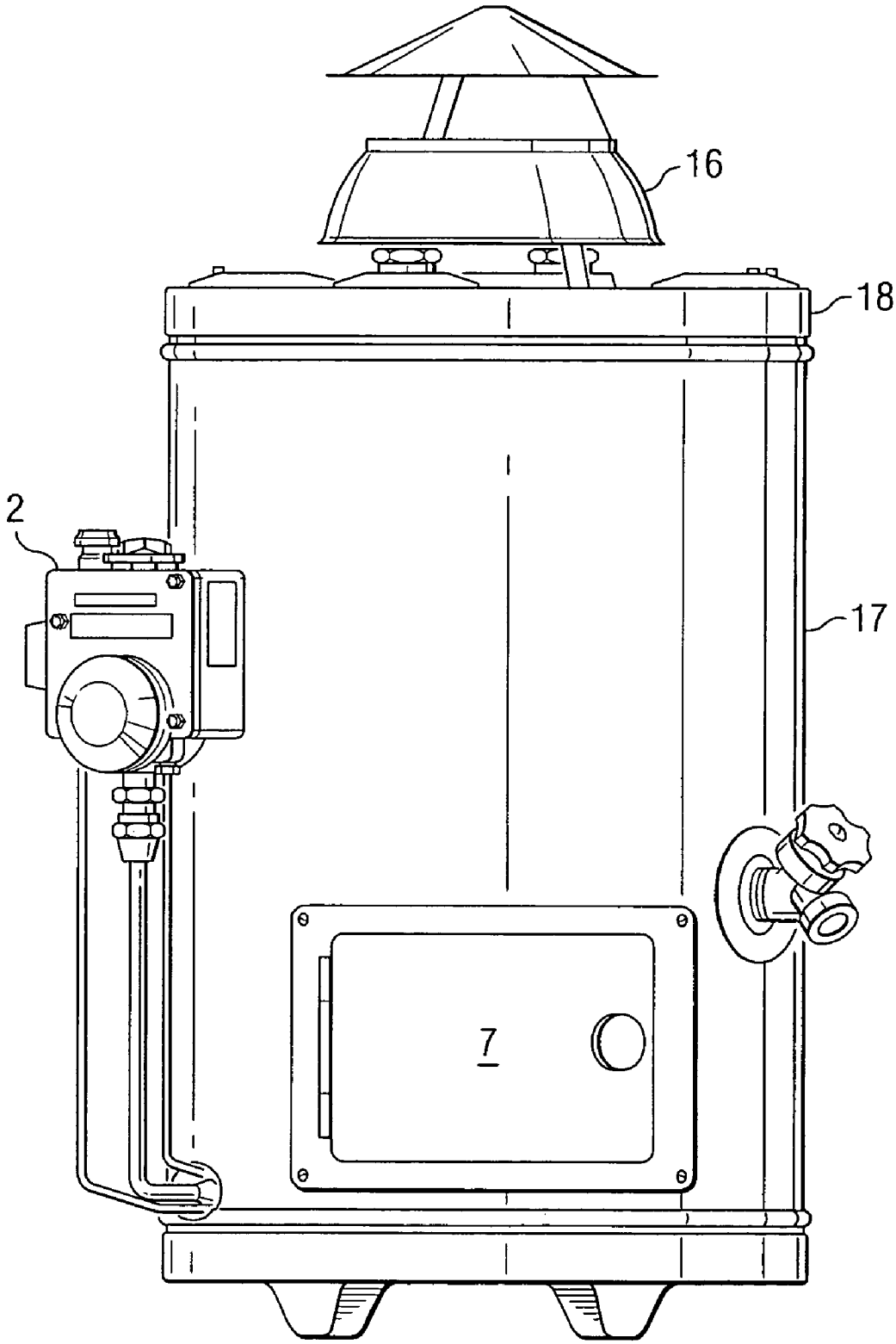
FIG. 1 is a complete water heater for reference purposes.

FIG. 1 shows the complete water heater for reference purposes, with a thermostat 2, a service door 7, a flue 16, an exterior cover 17, and an exterior lid 18.

Figure 2:
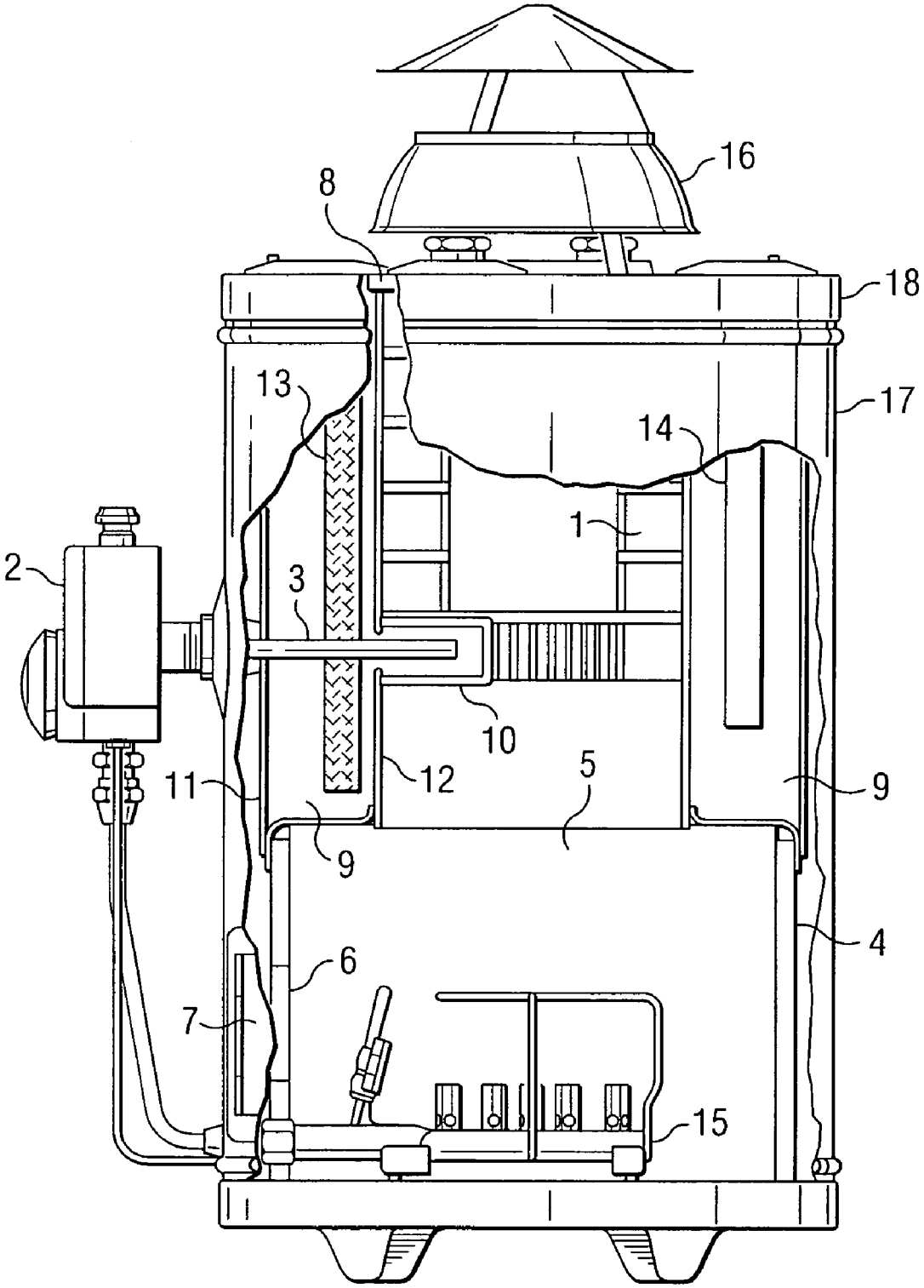
FIG. 2 is a cross section of the same water heater with the numbers indicating its major compounds.

FIG. 2 shows a cross section of the same water heater with a heat recuperator 1 as described in utility model No. 850 issued in Mexico by the IMPI and incorporated herein by reference, a thermostat 2 with a sensory bar 3, a combustion chamber 4, a deflector chamber 5, a sliding sheet curtain 6, a service door 7, a combustion gas collector 8, an annular-shaped tank 9 with the water that circulates inside the heater. The tank 9 is made up by an exterior wall 11 and an interior wall 12 and has a magnesium anode 13 to prevent corrosion and a plastic vein-type pipe 14 to carry cold water to the bottom of tank 9. It also has a burner 15 covered by a patent pending in Mexico at the IMPI and incorporated herein by reference, plus an exterior cover 17, an exterior lid 18, and a flue 16.

Figure 3:
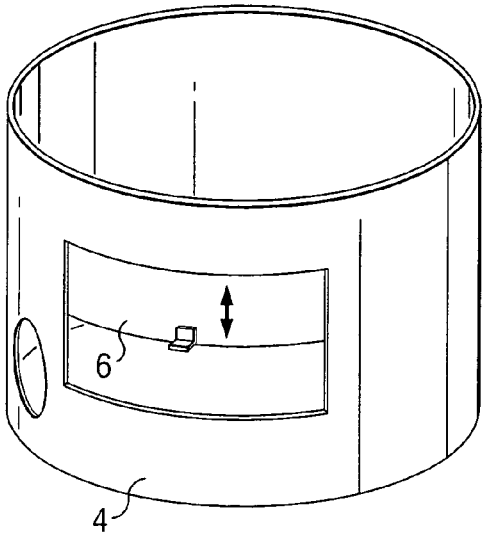
FIG. 3 is a detailed illustration of the combustion chamber and the radiation deflector curtain.
Figure 4:
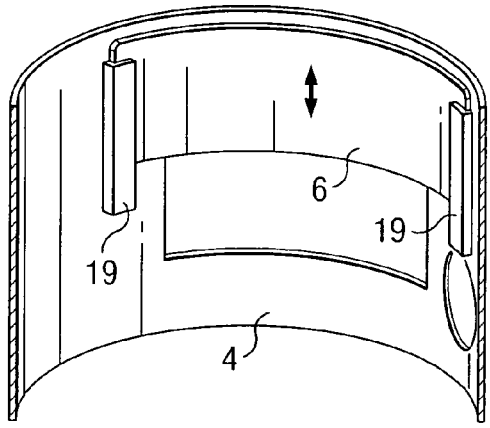
FIG. 4 is a cross section of the combustion chamber, the deflector curtain and the tracks that guide the movement of such deflecting curtain.

FIG. 3 is the combustion chamber 4 and the sheet deflector curtain 6 whose function is to contain any radiation emitted by burner 15 and thus prevent door 7, which is handled by the user, from getting hot. The sheet curtain 6 may be moved by hand upward and downward through the two tracks 19 as shown in FIG. 4, which are either welded or riveted to the combustion chamber 4. The sheet curtain 6 must be kept down in order to partially cover the cavity where door 7 is placed as shown on FIG. 3. When it is necessary to light the burner 15 pilot or visually inspect the inside of the combustion chamber 4, the sheet curtain 6 is lifted by hand. After the inspection is completed, the sheet curtain 6 is lowered to the down position.

Figure 5:
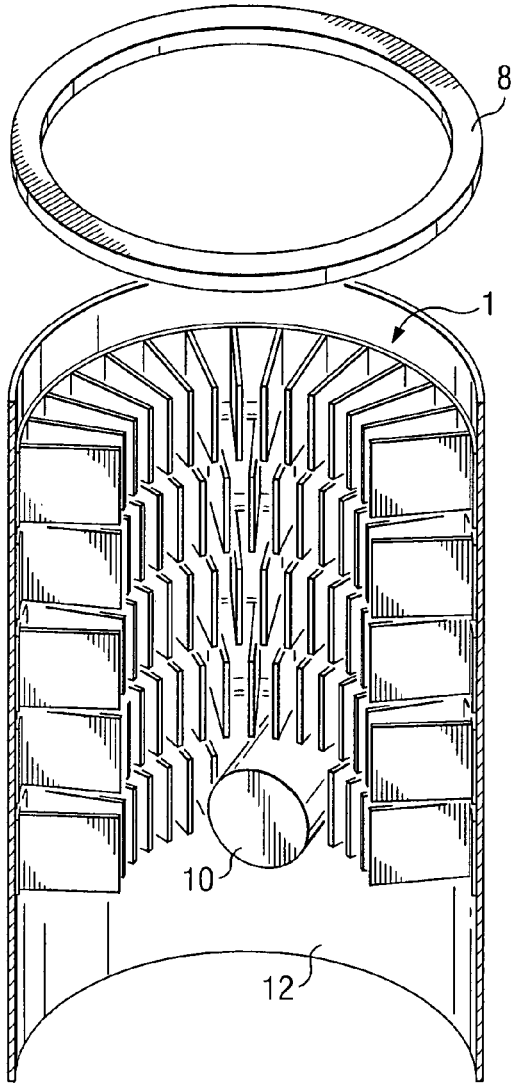
FIG. 5 is the combustion gas collector and a cross section of the heat recuperator, which shows the capsule that houses the thermostat sensory bar.

FIG. 5 is the combustion gas collector 8 and capsule 10 that houses part of the sensory bar 3 of thermostat 2, as shown on FIG. 2. The function of collector 8 is to prevent hot combustion gases from recuperator 1 from being in contact with exterior lid 18, whose finish paint would be damaged thereby. Capsule 10 may be made with a pipe section approximately 30 mm diameter and 50 mm long. Said capsule 10 is welded to wall 12. Wall 12 has a perforation about 20 mm in diameter concentric with capsule 10 so that sensory bar 3 of thermostat 2 of FIG. 2 extends through it. Capsule 10 is indispensable because the water heater which is described here is small and, as shown in FIG. 2, the annular-shaped water tank 9 is on the average 60 mm away from the exterior wall 11 and interior wall 12 and sensory bar 3 of the thermostat 2 is on the average 100 mm long. As a result, sensory bar 3 does not fit in the space of water tank 9. Capsule 10 is filled with the same water from tank 9 and, therefore, sensory bar 3 and thermostat 2 normally function as if tank 9 were bigger.

The following is suggested as an example of the preferred embodiment of the invention. A small water heater with a 29 cm outer diameter and a total height of 60 cm produces five liters of hot water per minute, with a difference of 25° C. between the water inlet and outlet, and an 85% thermal efficiency. This water heater has a heat recuperator 1 as shown in the description, a thermostat 2, a pipe capsule 10 to house the full sensory bar 3, a combustion chamber 4, a deflector chamber 5, a combustion gas collector 8, a water tank 9, a service door 7, a sheet sliding curtain 6, a plastic vein-type pipe 13, a magnesium anode 14, an exterior cover 17, an exterior lid 18, a flue 16, and a burner 15 that runs on combustible gas, with a power of 37,000 kj/hr.

What is claimed is:

1. A quick recovery water heater, comprising:

a recuperator;

a burner operable to heat the fluid in the tank;

a tank operable to hold a fluid;

a capsule in fluid communication with the tank;

a thermostat;

a sensory bar extending from the thermostat through the tank to the capsule.

2. The heater of claim 1, further comprising:

a combustion gas collector operable to prevent hot combustion gases of the recuperator from being in contact with an exterior of the heater.

3. The heater of claim 1, further comprising:

a magnesium anode in the tank operable to prevent corrosion.

4. The heater of claim 1, further comprising:

a pipe operable to carry a fluid to the tank.

5. The heater of claim 1, further comprising:

a combustion chamber surrounding the burner, the combustion chamber having a recess to access the burner.

6. The heater of claim 5, further comprising:

a service door operable to seal the recess.

7. The heater of claim 6, wherein the combustion chamber includes a sheet curtain operable to contain radiation emitted by the burner and protect the service door from heat emitted by the burner.

8. The heater of claim 1, wherein five liters of hot water is produced in one minute.

9. The heater of claim 1, wherein a temperature difference at an inlet of the tank from an outlet of the tank is 25° C.

10. The heater of claim 1, wherein a thermal efficiency of 85% is achieved by the heater.

11. The heater of claim 1, wherein the burner operates on combustible gas.

12. The heater of claim 1, wherein the burner provides a power of 37,000 kj/hr.

13. The heater of claim 1, wherein the capsule allows the thermostat to function as if the tank is bigger than its size.

* * * * *